United States Patent [19]

Arato

[11] Patent Number: 4,572,431

[45] Date of Patent: Feb. 25, 1986

[54] RAIL FASTENER ASSEMBLY

[75] Inventor: Michael P. Arato, Centereach, N.Y.

[73] Assignee: Penta Construction Corp., East Northport, N.Y.

[21] Appl. No.: 275,710

[22] Filed: Jun. 22, 1981

[51] Int. Cl.[4] ..... E01B 9/62; E01B 9/68; E01B 5/18

[52] U.S. Cl. ..... 238/283; 238/20; 238/308

[58] Field of Search ..... 238/17, 18, 264, 283, 238/304, 281, 283, 308, 20, 21, 217, 351

[56] References Cited

U.S. PATENT DOCUMENTS

| | | | |
|---|---|---|---|
| 3,494,558 | 2/1970 | Brown | 238/283 X |
| 3,576,293 | 4/1971 | Landis et al. | 238/283 X |
| 3,653,591 | 4/1972 | Varga et al. | 238/308 |
| 3,784,097 | 1/1974 | Landis | 238/283 X |
| 3,858,804 | 1/1975 | Hixson | 238/283 X |
| 4,047,663 | 9/1977 | Reynolds et al. | 238/304 |
| 4,062,490 | 12/1977 | Hixon | 238/264 X |
| 4,150,791 | 4/1979 | Reyonolds et al. | 238/283 X |
| 4,208,011 | 6/1980 | Dahlhaus et al. | 238/281 |
| 4,325,510 | 4/1982 | Sherrick | 238/283 X |

*Primary Examiner*—Randolph A. Reese
*Attorney, Agent, or Firm*—Pennie & Edmonds

[57] ABSTRACT

A rail fastener is described comprising a rail plate, a rail seat defined in an upper surface of the rail, rigid rail clips for engaging the flanges of the rail, bolts for securing the rail clips to the plate, a resilient pad mounted underneath the rail seat and extending the full width of the rail plate, and apparatus for securing the plate and pad against lateral movement with respect to the support structure while permitting the plate to move vertically. The plate securing apparatus preferably comprises a plurality of holes in the rail plate and pad, a tube within each hole, and a support plate on which the tube rests. Each tube has a hollow center and each support plate has a hole aligned therewith. A fastening element is driven through each tube and hole to secure the tube to the underlying support structure without contacting the rail plate. As a result, the tube and the fastening element prevent lateral movement of the rail plate and pad under lateral shear forces while the rail clip and its securing bolt permit adjustment of the position of the rail in the rail seat. Since the fastening element does not bear on the rail plate, the rail plate may move in the vertical direction in response to the forces exerted on it by a vehicle traveling on the rail. However, the vibrations created by such movement are damped by the resilient pad.

16 Claims, 2 Drawing Figures

FIG. 1
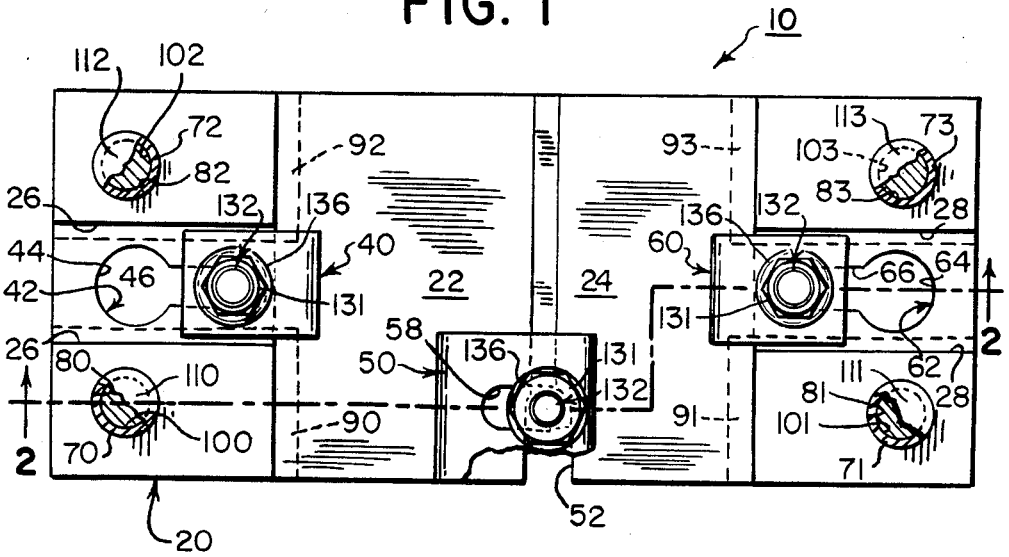
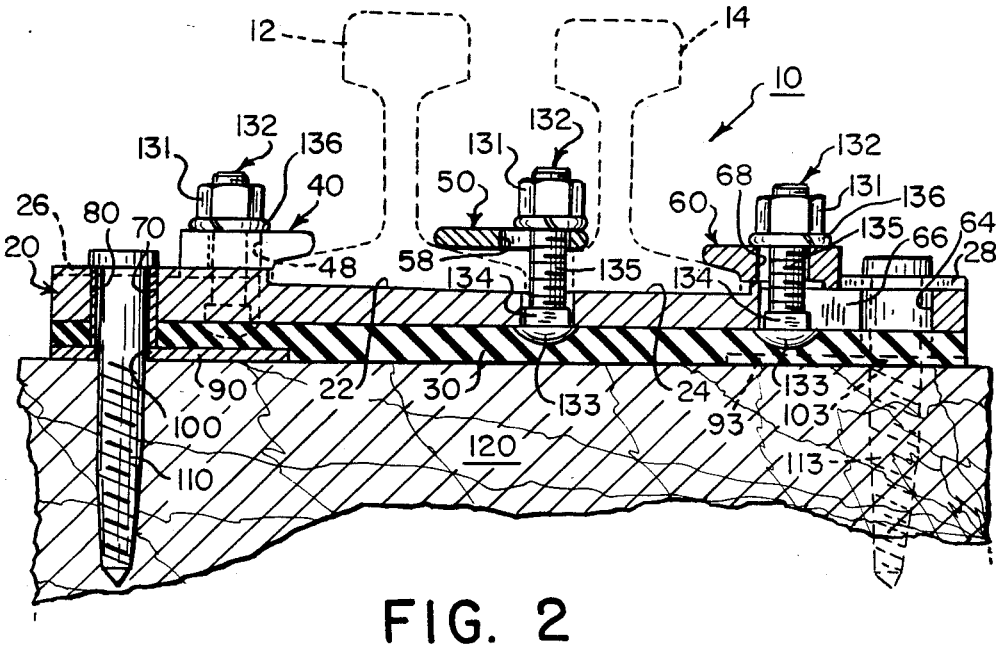
FIG. 2

RAIL FASTENER ASSEMBLY

BACKGROUND OF THE INVENTION

This invention relates generally to a rail fastener of the type used to secure railroad track to an underlying support structure. More particularly, it relates to a rail fastener which provides improved vibration and sound attenuation between the rail and its supporting structure, good resistance to lateral shear forces acting on the rail and good wearing qualities.

As described in detail in U.S. Pat. No. 4,047,663, direct fixation of a rail to a support structure is not a simple matter. Structural integrity must be maintained between the rail and the support structure while vibrations generated in the rail must be attenuated before reaching the support structure. At the same time, the rail fastener must be capable of permitting lateral adjustment or positioning of the rail with respect to the support structure while also providing sufficient resistance to lateral shear forces that can be imposed on the rail especially on curves.

As a vehicle moves along a rail, a wave is built up in the rail in front of the vehicle because of the localized vertical forces applied to the rail by the wheels of the vehicle. The rail acts as a lever causing each portion of the rail to be subjected first to an upward force as the vehicle approaches, a downward force as the wheels roll thereover and another upward force as the vehicle leaves. Where the rail is directly affixed to the support structure, this wavelike motion will produce a pounding action between the rail and the supporting structure. Unless some device is provided between the rail and the structure to absorb this impact, this pounding will ultimately result in failure of the rail, the fastener, or the underlying structure.

In addition to the deleterious effects on the structure caused by the pounding action, undesirable sonic vibrations will be applied to the surrounding structures. Thus, suitable apparatus must be incorporated into the rail fastener device to attenuate the noise which would otherwise be transmitted into surrounding buildings and other structures.

As will be apparent, these competing requirements inevitably lead to compromises. The rail fastener must be both sufficiently rigid to provide structural integrity between the rail and the support structure, and sufficiently non-rigid to attenuate the vibrations transmitted from the rail to the support structure. In an effort to satisfy these and other requirements, rail fasteners have been devised such as those shown in U.S. Pat. Nos. 3,858,804 and 4,047,663 that include a shear pad which is formed of a pair of metallic plates having a layer of elastomeric material sandwiched therebetween. The shear pad is secured to the support structure by a pair of studs or bolts and additional means are provided for laterally positioning the rail with respect to the shear pad and support structure.

These prior art devices tend to be quite complicated. In addition, the anchor between the rail plate and the support structure is a potential source of structural failure. The anchor bolts pull the fastener and the support structure together, thereby placing a portion of the support structure in tension. Such tensioning of the support structure around the anchor bolts contributes to its ultimate fatigue. The pounding of the rail plate against the anchor bolt causes vibration in the anchor bolt which will eventually weaken the portion of the support structure in which it is seated. The pounding may also fatigue the anchor bolt itself. As a result either the anchor bolt will ultimately fracture or the support structure will lose its grip on the bolt.

Since the rail is subject to overturning movements and lateral shear forces, especially on curved portions of the track, it can not be permitted to move laterally when such shear forces are imposed lest the gauge of the track be altered. At the same time, the fastener must be capable of some lateral adjustment of the rail with respect to the support structure so as to maintain the correct gauge as the rail is worn down through use.

In the above referenced '804 patent, the rail can be adjusted by adjusting the position of rail support clip 50 or the rail fastener itself. To lock the support clip or rail fastener in position, serrated edges are provided on the clip or the fastener and on mating elements which engage these elements. As will be apparent, the use of serrated components increases the cost of the device and greatly limits the number of adjustments that can be made to its position. The '663 patent discloses the use of eccentric cams 44, 46 to provide lateral adjustment of the rail plate. This arrangement, however, is likely to require extensive inspection and maintenance to ensure that the cams remain in the desired position and that the gage remains constant. In addition, while the Pandrol clips disclosed in the '663 patent provide a resilient restraint on upward movement of the rail under the leverage action of a vehicle moving along the rail, it will be apparent that the fastener shown in the '663 patent is complicated in design and manufacture and that its installation and maintenance is likely to be expensive.

SUMMARY OF THE INVENTION

I have devised a relatively simple rail fastener which provides for attenuation of the vibrations generated in the rail, permits some lateral adjustment of the rail in order to maintain the correct gauge and also provides substantial resistance to lateral shear forces on the rail. In a preferred embodiment of my invention, the rail fastener comprises a rail plate, a rail seat defined in an upper surface of the railplate, at least one rigid rail clip for clamping a flange of the rail, apparatus for securing the rail clip to the plate, a resilient pad mounted underneath the rail seat and extending the full width of the rail plate, and apparatus for securing the plate and pad against lateral movement with respect to the support structure while permitting the plate to move vertically. The plate securing apparatus preferably comprises a plurality of holes in the rail plate and pad, a tube within each hole, and a support plate on which each tube rests. Each tube has a hollow center and each support plate has a hole aligned therewith. A fastening element is driven through each tube and hole to secure the tube to the underlying support structure without contacting the rail plate. As a result, the tube and the fastening element prevent lateral movement of the rail plate and pad under lateral shear forces while the rail clip and its securing apparatus permit adjustment of the position of the rail in the rail seat. Since the fastening element does not bear on the rail plate, the rail plate may move in the vertical direction in response to the forces exerted on it by the vehicle traveling on the rail. However, the vibrations created by such movement are damped by the resilient pad.

BRIEF DESCRIPTION OF THE DRAWING

These and other objects, elements, features and advantages of my invention will be more readily apparent from the following detailed description of the invention in which:

FIG. 1 is a plan view of an illustrative embodiment of a rail fastener in accordance with my invention, and FIG. 2 is a cross-sectional view of the rail fastener along line 2—2 of FIG. 1.

DETAILED DESCRIPTION OF THE INVENTION

As shown in FIGS. 1 and 2, an illustrative embodiment of a rail fastener 10 of my invention comprises a rail plate 20, a resilient pad 30, rail clips 40, 50, 60, tubes 70, 71, 72, and 73 which are loosely fitted into holes 80, 81, 82, and 83 in rail plate 20 and pad 30, and support plates 90, 91, 92, and 93 which underlie portions of pad 30 and support the tubes. Rail plate 20, pad 30 and support plates 90–93 are bonded together in known fashion to form a single structure. Holes 100–103 in plates 90–93 are substantially the same size as the inner diameter of tubes 70–73 and are aligned therewith.

Clips 40, 50, 60 clamp the flanges of a main rail 12 and a guard rail 14 to secure these rails to rail seats 22, 24, respectively, defined in the upper surface of rail plate 20. Advantageously, the rail seat 22 is slightly larger than the width of the flange of the rail (e.g., about 3/16 inch (5 mm.) larger) to permit adjustment of the position of the rail if the track gauge should be altered by wear on the load-bearing surface of the rail. As shown in FIG. 2, rail seat 22 is canted with a slope of one in forty as is required by some transit systems. Obviously, the rail seat could be flat or canted other amounts if desired. The invention may also be practiced with a rail fastener that secures only one rail simply by eliminating guard rail 14 and clip 50 and using clip 60 to fasten the second flange of main rail 12.

The interior diameter of tubes 70–73 and the size of holes 100–103 are large enough that conventional screw spikes 110–113 may be driven through each of them to secure the rail fastener to an underlying support structure 120. Illustratively, this support structure is a conventional wooden railroad tie. The walls of tubes 70–73 are thick enough that the heads of spikes 110–113 bear only on the tubes and do not contact rail plate 20. The outer diameter of tubes 70–73 and the size of holes 80–83 are such that the tubes fit loosely within the holes and do not cause any substantial resistance to the vertical movement of rail plate 20.

Each rail clip 40, 50, 60 is secured to the rail plate by a nut 131 and a bolt 132. Each bolt comprises a head 133, a square bearing surface 134 and a shaft 135. The heads of the bolts which secure clips 40 and 60 are fitted underneath rail plate 20 through holes 42, 62 in the plate and underlying pad. Each hole 42, 62 includes a first portion 44, 64 which is larger than the head of the bolt and a narrower slotted portion 46, 66 having a width smaller than the diameter of the head of the bolt and slightly larger than the width of the square bearing surface 134. The head of the bolt which secures clip 50 is fitted underneath rail plate 20 through a slot 52 in the edge of the plate. The width of this slot is smaller than the diameter of the head and slightly larger than the width of the square bearing surface. In each clip 40, 50, 60 there is a hole 48, 58, 68 large enough to receive therethrough the shaft of a bolt but small enough that the clip supports a nut when it is threaded onto the bolt.

To fasten a rail to an underlying support structure using the rail fastener of my invention, the rail fastener is first secured to the support structure at the correct position so that the rail will fit into the rail seat and be adjustable in the direction that will compensate for wear on the rail. Each tube serves to center the screw spike while it is being driven into the underlying support structure. When the screw spike is secure, the tube locks the support plate against vertical movement away from the support structure and also prevents lateral movement of the rail fastener. However, since the head of the screw spike does not contact the rail plate, rail plate 20 may move in response to the up and down forces imposed by the vehicle moving on the rails. Such movement of the rail plate will, however, be damped by resilient pad 30.

After the rail fastener is secured to the support structure, the rails are put in place in the rail seat. A bolt is then fitted into slot 52; clip 50 and a washer 136 are slipped onto its shaft; and a nut is threaded on. Next, the heads of two bolts 132 are fitted through the larger portions 44, 64 of holes 42, 62 and their shafts are slipped along slots 46, 66 to the proper location for securing the rails. A rail clip 40 or 60 and a washer 136 are then fitted onto the bolt shafts; and nuts 131 are threaded onto the bolt shafts to lock the rail clips in the desired position. While the nuts are being tightened, square bearing surfaces 134 engage the sides of slots 46, 52, 66 and prevent the shafts of the bolts from turning. If it is desired to change the position of the rails in their seats, this can be accomplished without disturbing the mounting of the rail fastener to the underlying structure simply by loosening the nuts, shifting the rail to the desired position, and tightening the nuts anew.

Rail plate 20 illustratively is a steel plate about 7¾ inches (19.7 cm.) long and 1⅛ inches (28 mm.) thick. For the main rail and guard rail embodiment shown in FIG. 1, the plate is 19 inches (48 cm.) wide. For a single rail embodiment, the plate would be approximately 15 inches (38 cm.) wide. To facilitate positioning of rail clips 40, 60, grooves 26, 28 are milled in the upper surface of the plate. Because of the cant in rail seat 22, groove 26 is shallower than groove 28, being ⅛ inch (3 mm.) deep while groove 28 is ¼ inch (6 mm.) deep. Resilient pad 30 illustratively is ¾ inch (19 mm.) thick, except in the region of support plates 91–93. The pad is made of a conventional elastomeric material such as that used in the rail plates described in the aforementioned '804 and '663 patents. To bond the pad to rail plate 20 and support plates 90–93, the contacting surfaces are cleaned, dried and primed with a suitable adhesive after which they are bonded by application of heat and pressure. Support plates 90–93 are steel plates ¼ inch (6 mm.) thick, 5 inches (13 mm.) wide and 3 inches (8 mm.) long. Alternatively, a single support plate could be used on each side of the rail fastener or even one continuous support plate underlying the entire rail fastener.

Rail clips 40, 60, are conventional steel clamps shaped to mate with the flanges of rails 12, 14. Clip 50 is a flat bar ⅜ inch (10 mm.) thick and 3 inches (7.6 cm.) square. Advantageously, the holes in clips 40, 50, 60 are ovals to permit adjustment of the clips with respect to the shafts of bolts 132. Bolts 132 illustratively are ¾ inch (19 mm.) by 3½ inch (9 cm.) carriage bolts. Tubes 70–73 advantageously may be cut from steel pipe having 5/32 inch (4 mm.) wall. The length of each tube is about 1½ inches (38 mm.). To secure such tubes with conventional rail spikes having a diameter of 1 inch (25 mm.), the tubes should have an inner diameter of about 1-1/16 inches (27 mm.) and the diameter of holes 80–83 in rail plate 20 should be about 1½ inches (38 mm.) so that the tube does not interfere with vertical movement of the rail plate. Holes 100–103 in support plates 90–93 should be approximately the same size as the inner diameter of tube 70–73.

As will be apparent to those skilled in the art, numerous modifications may be made in the above described rail fastener within the spirit and scope of my invention. For example, from the foregoing description it will be apparent how to modify many of the different types of conventional rail fasteners in accordance with the invention. In addition to the screw spikes used to secure the rail fastener to the underlying support structure, the invention may be practiced with other types of fastening elements. If desired, it may also be possible to eliminate use of tubes 70–73 simply by using screw spikes or other types of fastening elements with enlarged heads 1½ inches (38 mm.) high that secure the support plates to the support structure and also prevent lateral movement of the rail plate.

What is claimed is:

1. Apparatus for fastening a rail to an underlying support structure comprising:

a rail plate, a rail seat defined in an upper surface of said rail plate for supporting said rail, at least one rail clip for engaging a flange of said rail, means for securing said rail clip to said plate whereby said rail is held in said rail seat, a resilient pad mounted underneath said rail seat and extending the full width of said rail plate, means for securing said plate and pad against lateral movement with respect to said underlying support structure while permitting the plate to move vertically, said means comprising first and second holes extending through said plate and said pad on opposite sides of the rail seat, first and second hollow-centered tubes shaped to fit loosely within and directly adjacent the sides of said holes and having a length that is at least approximately the thickness of said rail plate and said pad in the region of said hole and first and second fastening elements having a shaft that fits through a hollow center of a tube and a head that bears only on an upper edge of the tube but is smaller than the holes that extends through the plate, said fastening elements securing said tubes to said underlying support structure and thereby preventing lateral movement of said rail plate and pad with respect to said support structure while the loose fit of said tubes in said holes and the size of the head of the fastening elements permit vertical movement of said rail plate with respect to said support structure.

2. The apparatus of claim 1 wherein each rail plate further comprises third and fourth holes on opposite sides of the rail seat and third and fourth tubes shaped to fit within said holes and having a length that is at least approximately the thickness of said rail plate and said pad, said tubes having a hollow center through which is driven a fastening element which secures said tube to said underlying support structure.

3. The apparatus of claim 2 further comprising at least one support plate means underneath said resilient pad in the area of each of said first, second, third and fourth holes, said support plate means having therethrough holes which align with the hollow centers of said tubes and through which said fastening elements may be driven, said tubes bearing on each support plate means so that the plate means is secured to the underlying support structure when the fastening element is in place.

4. The apparatus of claim 1 further comprising at least one support plate means underneath said resilient pad in the area of each of said first and second holes, said support plate means having therethrough holes which align with the hollow centers of the tubes and through which said fastening elements may be driven, said tube bearing on each support plate means so that the plate means is secured to the underlying support structure when the fastening element is in place.

5. The apparatus of claim 3 or claim 4 wherein the resilient pad is bonded to said rail plate and to the support plate means underneath said pad, whereby said pad resiliently restrains upward movement of said rail plate.

6. The apparatus of claim 1 wherein the means for securing said rail clip to said rail plate comprises a nut and a bolt, said bolt having a head and threaded shaft, and holes in said rail plate and said clip, said hole in said clip being large enough to receive therethrough the shaft of said bolt and small enough to support said nut when said nut is threaded onto said shaft, said hole in said rail plate having a first portion which is larger than the head of said bolt and a second portion which is a slot having a width that is larger than the diameter of said shaft but smaller than said head, whereby the head of said bolt may be inserted underneath the rail plate through the first portion of said hole but prevented from upward movement when the bolt is within said slot.

7. The apparatus of claim 1 wherein the rail seat is larger than the base of said rail, whereby the position of said rail may be adjusted by moving it in said rail seat.

8. The apparatus of claim 1 wherein said rail clip is rigid.

9. The apparatus of claim 1 wherein the rail seat is canted.

10. Apparatus for fastening a rail to an underlying support comprising:

a rail plate, a rail seat defined in an upper surface of said rail plate for supporting said rail, at least one rail clip for engaging a flange of said rail, means for securing said rail clip to said plate whereby said rail is held in said rail seat, a resilient pad mounted underneath said rail seat and extending the full width of said rail plate, and means for securing said plate and pad against lateral movement with respect to said underlying support structure while permitting the plate to move vertically, said means comprising first and second holes extending through said plate and said pad on opposite sides of the rail seat and first and second fastening elements shaped to fit loosely within and directly adjacent the sides of said holes and protruding above the underlying structure by a distance that is at least approximately the thickness of said rail plate and said pad in the region of said hole, said fastening elements preventing lateral movement of said rail plate and pad with respect to said support structure while the loose fit of said fastening elements in said holes permits vertical movement of said rail plate with respect to said support structure and said fastening element.

11. The apparatus of claim 10 further comprising at least one support plate means underneath said resilient pad in the area of said first and second holes, said support plate means having therethrough holes which align with said holes in the rail plate and through which said fastening elements may be driven, said fastening elements bearing on each support plate means so that the plate means is secured to the underlying support structure when the fastening elements are in place.

12. The apparatus of claim 11 wherein the resilient pad is bonded to said rail plate and to said plate means underneath said pad, whereby said pad resiliently restrains upward movement of said rail plate.

13. The apparatus of claim 10 wherein the rail seat is larger than the base of said rail, whereby the position of said rail may be adjusted by moving it in said rail seat.

14. The apparatus of claim 10 wherein the rail seat is canted.

15. Apparatus for fastening a rail to an underlying support structure comprising:

a rail plate, a rail seat defined in an upper surface of said rail plate for supporting said rail, at least one rail clip for engaging a flange of said rail, means for securing said rail clip to said plate whereby said rail is held in said rail seat, a resilient pad mounted underneath said rail seat and extending the full width of said rail plate, said pad being bonded to said rail plate, means for securing said plate and pad against lateral movement with respect to said underlying support structure while permitting the plate to move vertically, said means comprising at least one support plate means underneath said resilient pad on each side of the rail seat and bonded to said resilient pad and at least one hole on each side of the rail seat extending through said rail plate, said pad and said support plate means, the portion of the hole in each support plate means being smaller than the portion of the hole in said rail plate and pad so that a portion of the surface of the support plate means is exposed through the hole in said rail plate and the pad, whereby when fastening means are mounted in said holes to secure said support plate means to said underlying support structure, a first portion of each fastening means extends through the hole in the support plate means and another portion that is larger than the hole in the support plate means but smaller than the hole in the rail plate and pad bears on the exposed surface of the support plate means while fitting loosely within and directly adjacent the sides of the hole through the rail plate and pad so as to prevent lateral movement of said rail plate and pad with respect to said support structure while permitting upward movement of said rail plate relative to the fastening means subject to resilient restraint by the pad.

16. The apparatus of claim 15 wherein the rail seat is larger than the base of said rail, whereby the position of said rail may be adjusted by moving it in said rail seat.

* * * * *